US012391436B2

(12) United States Patent
Gruen et al.

(10) Patent No.: US 12,391,436 B2
(45) Date of Patent: Aug. 19, 2025

(54) HYBRID CONTAINER

(71) Applicant: Sabert Corporation, Sayreville, NJ (US)

(72) Inventors: Sarah Catherine Gruen, Fords, NJ (US); Kurt Wolf, Chicago, IL (US); Jason Schuler, Rochester, NY (US); Yohanan Siskindovich, Florham Park, NJ (US)

(73) Assignee: Sabert Corporation, Sayreville, NJ (US)

( * ) Notice: Subject to any disclaimer, the term of this patent is extended or adjusted under 35 U.S.C. 154(b) by 0 days.

(21) Appl. No.: 18/381,036

(22) Filed: Oct. 17, 2023

(65) Prior Publication Data

US 2024/0140655 A1 May 2, 2024

Related U.S. Application Data

(60) Provisional application No. 63/420,394, filed on Oct. 28, 2022.

(51) Int. Cl.

| | |
|---|---|
| ***B65D 43/02*** | (2006.01) |
| ***B65D 5/64*** | (2006.01) |
| ***B65D 21/02*** | (2006.01) |

(52) U.S. Cl.

CPC ..... *B65D 43/0208* (2013.01); *B65D 5/64* (2013.01); *B65D 21/0219* (2013.01);
(Continued)

(58) Field of Classification Search

CPC ..... B65D 5/4612; B65D 43/0208; B65D 21/0219; B65D 2543/00537; B65D 2543/00601; B65D 2543/00796
(Continued)

(56) References Cited

U.S. PATENT DOCUMENTS 2,935,108 A * 5/1960 Hall ..... B65D 43/0212 220/675
3,767,110 A * 10/1973 Congleton ..... B65D 43/162 220/4.23

(Continued)

FOREIGN PATENT DOCUMENTS

AT 524676 A4 * 8/2022 ..... B65D 43/0212
CA 2159422 A1 * 3/1997
DE 2220274 A1 * 11/1972

*Primary Examiner* — Anthony D Stashick
*Assistant Examiner* — Symren K Sanghera
(74) *Attorney, Agent, or Firm* — COZEN O'CONNOR

(57) ABSTRACT

A hybrid container has an integrally formed base made from a paper material and an integrally formed lid made from a plastic material. The base defines a volume with a bottom and opposing first sidewalls that form an upper peripheral rim. The base has at least two flaps, one extend from each opposing first sidewall, configured as a loop with a central opening and pivotable with respect to its first sidewall. The lid is dimensioned for positioning on the upper peripheral rim of the base and has an upper surface, opposing second sidewalls, and at least two receiving regions each formed on opposing second sidewalls and having a seat dimensioned for releasable engagement with the central opening of each flap. Each of the receiving regions is angled with respect to the upper surface of the lid to completely receive one flap when the connected to the seat.

12 Claims, 8 Drawing Sheets

(52) U.S. Cl.
CPC ..... *B65D 2543/00296* (2013.01); *B65D 2543/00537* (2013.01); *B65D 2543/00796* (2013.01)

(58) Field of Classification Search
USPC ..... 220/324, 326, 780
See application file for complete search history.

(56) References Cited

U.S. PATENT DOCUMENTS

| | | | | | |
|---|---|---|---|---|---|
| 3,795,360 | A * | 3/1974 | Bianchi | B65D 43/0212 | D7/392.1 |
| 4,079,880 | A * | 3/1978 | Edwards | B65D 45/20 | 220/4.23 |
| 4,776,459 | A * | 10/1988 | Beckerman | B65D 43/0214 | 229/128 |
| 4,986,438 | A * | 1/1991 | Borst | B65D 45/20 | 229/406 |
| 6,666,348 | B2 * | 12/2003 | Fore | B65D 45/20 | 220/676 |
| 7,328,814 | B2 * | 2/2008 | Nordland | B65D 25/2894 | 220/756 |
| 8,517,196 | B2 * | 8/2013 | Chang | B42F 7/14 | 206/451 |
| 2006/0021889 | A1 * | 2/2006 | Kim | A45C 11/00 | 206/320 |
| 2013/0205722 | A1 * | 8/2013 | Burkardt | B65D 19/38 | 53/449 |
| 2022/0363449 | A1 * | 11/2022 | Lee | B65D 45/20 | |
| 2024/0043196 | A1 * | 2/2024 | Welle | B65D 81/3886 | |

* cited by examiner

HYBRID CONTAINER

RELATED APPLICATIONS

This application claims priority from U.S. Provisional Patent Application Ser. No. 63/420,394, filed Oct. 28, 2022, and incorporated herein by reference as if fully set forth.

1. FIELD OF THE INVENTION

The present invention is in the field of food storage containers which have a base and a detachable lid. More particularly, the present invention is directed to a hybrid container where the base may be formed of environmentally-friendly materials which are either recyclable or biodegradable, and the lid may be formed of a plastic translucent or transparent material that may also be recyclable.

2. DESCRIPTION OF THE RELATED ART

Food storage containers and food packaging have become increasingly common, particularly in connection with the carry-out food industry. With the rise in their prevalence, so did the environmental challenges they present. For this reason, container/packaging manufacturers are ever more tasked with developing better sustainable and eco-friendly alternatives to traditional all-plastic containers.

For many years, both plastic and paper were used for food packaging applications due to their intrinsic qualities. Plastic, due to its transparent or translucent properties, showcases the food vividly and limits food order inaccuracy by simple visual inspection of the container contents. Plastic can also be accurately formed to create reliable locking features that secure a lid and base of a container assembly to each other, and possibly to other containers as well, when the packaged food is in transit, and also effectively preserve the shelf life of the food contents. Paper, such as pressed pulp, is also a very common packaging substrate because it provides excellent branding opportunities when printed, good insulation when corrugated, cost-effective shipping efficiencies when packed flat, and many other benefits.

Although plastics used for packaging can be reclaimed and recycled, paper substrates are significantly more likely to be recycled or biodegrade overtime. For these and many other reasons, there are demonstrated benefits to develop mixed material packages that are designed to minimize the usage of plastics when possible without compromising on overall performance. These so-called hybrid containers contain a base made of a paper material, and a lid made of a plastic translucent material. The plastic material allows visual inspection of the food contained in the container, and the paper material base provides for a highly functional vessel for various food applications and branding opportunities. The combination of these two substrate categories delivers on both functionality and environmental considerations.

FIGS. 1-5 show a prior art hybrid container 10. FIGS. 1 and 4 are perspective views of the prior art hybrid container 10. FIG. 2 is a front view of the prior art hybrid container 10 of FIGS. 1 and 4. FIG. 3 is a side view of the prior art hybrid container 10 of FIGS. 1 and 4. FIG. 5 is a side view showing a stack of the prior art hybrid containers. FIGS. 1-5 are best viewed together with the following description.

The hybrid container 10 includes a base 12 made of paper, and a lid 14 made of plastic. The lid is molded in any desired shape and includes a lip 30 that engages an upper edge 24 of base 12. The base further includes a bottom 26, sidewalls 22, and upper edge 24 which engages lid 14. The sidewalls and bottom define a volume in which food is stored. The walls are tapered to provide structural integrity to the base and aid in nesting within each other when in a stack.

Base 12 is made of a flat sheet of paper stock, such as pressed pulp, which is then folded along a plurality of fold lines 28 to form an intended shape. The paper stock is of sufficient rigidity to function as a food container and may also be coated or laminated on a surface, namely the surface that forms the inside of the base, with a hydrophobic material to limit water or oil absorption. As shown, the base further contains a pair of loop-shaped flaps 16 (also known as handles) having a hollow portion cut out 20.

The lid 14 includes an overhang 32 from lip 30 that is dimensioned to receive the upper edge 24 of base 12 when the lid is mounted thereto in an intended manner. The lid includes a top surface 34 and various strengthening features 36, such as ribs, push outs, and so on to provide strength. The lid 14 also includes upstanding rails 42 extending from the top surface in a direction away from the base 12. Lastly, the lid includes a pair of receiving regions 44 arranged to receive portions of loop-shaped flaps 16 of opposing sidewalls 22. The receiving regions 44 each include a seat 18 dimensioned to engage with a hollow portion 20 of each flap 16. In particular, the receiving regions 44 are configured as recesses with the outward seat 18 that is received in hollow portion 20 to releasably attach the flaps 16, and thereby the base 12, to the lid 14.

As a result of the configuration of the lid 14 and the flaps 16, when the lid is positioned on the base and the flaps 16 engage with seats 18 of the receiving regions 44, portions of the flaps 16 extend a distance 17 above the lid 14, as shown in FIGS. 2 and 3. The flaps 16 are vulnerable to unintentional contact due to their protrusion away from lid 14 that may result in disengagement of flaps 16 from the lid 14, and thereby release of the base 12 from the lid 14. FIG. 3 shows this vulnerability, indicating a bottom protruding region 16A of the flaps 16, and a top protruding region 16B of the flaps 16. Thus, the container 10 of the prior art is susceptible to accidental disengagement of the base and lid after those components are connected to each other.

In addition, it is desirable for such hybrid containers to be stackable in a vertical orientation such that carry-out food orders, or identical food products, may be arranged for vendor organization, food delivery, and/or easy consumer access. However, as shown in FIG. 5, the prior art hybrid container 10 cannot be vertically stacked with like containers, with each hybrid container in a fully horizontal position, because the flaps 16 interfere with seating of stacked hybrid containers. As shown in FIG. 5, the flaps 16(1) of a lower hybrid container 10(1) prevent the base 12(2) of a middle hybrid container 10(2) from sitting flush on the lid 14(1) of the lower hybrid container 10(1), and the flaps 16(2) of the middle hybrid container 10(2) prevent the base 12(3) of a top hybrid container 10(3) from sitting flush on the lid 14(2) of the middle hybrid container 10(2). Thus, stacked prior art hybrid containers 10 are susceptible to tipping. A further problem of the prior art hybrid container 10, particularly for the lower containers when stacked, is that the flaps 16 are prone to accidental disengagement.

SUMMARY OF THE DISCLOSURE

Embodiments described herein combine functional characteristics associated with plastics such as excellent food display, robust product stacking, inherent structural integrity, and highly secured locking features, with many of the benefits paper exhibits such as branding opportunities, sustainable attributes, various trimming and punching geometries, and much more. In addition, the disclosed embodiments improve engagement between a base and a lid of a hybrid container.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

In certain embodiments, a hybrid container includes an integrally formed base made from a paper material and having a bottom, opposing first sidewalls forming an upper peripheral rim, and at least two flaps each configured as a loop with a central opening and extending from a different one of the opposing first sidewalls and pivotable with respect to its first sidewall; an integrally formed plastic lid dimensioned for positioning on the upper peripheral rim of the base and having an upper surface, opposing second sidewalls, and at least two receiving regions each formed on a different one of the opposing second sidewalls and having a rear plane formed, with respect to the upper surface of the lid, at a shallower angle than an angle of a plane of its second sidewall, each receiving region forming a seat dimensioned to engage with the central opening of one of the flaps to removably retain the flap completely within the receiving region.

In one embodiment, the flaps do not extend outside of the plane of the container second sidewall when the flap is retained by its seat.

In another embodiment, the container uses plastic material which is transparent or translucent.

In another embodiment, the container lid has a strengthening ring formed at the upper surface and may also include a trough formed at the upper surface without extending above the upper surface.

In still another embodiment, the lid further has a lip which engages the upper peripheral rim of the base and has an overhang extending from the lip and dimensioned to receive the upper peripheral rim when the lip engages the upper peripheral rim.

In still another embodiment, the container lid has a plurality of upstanding rails extending from the upper surface in a direction away from the base and wherein the upstanding rails are positioned around at least part of a periphery of the upper surface to fully receive a bottom of a stacked second hybrid container.

DETAILED DESCRIPTION OF THE EMBODIMENTS

Figure 6:
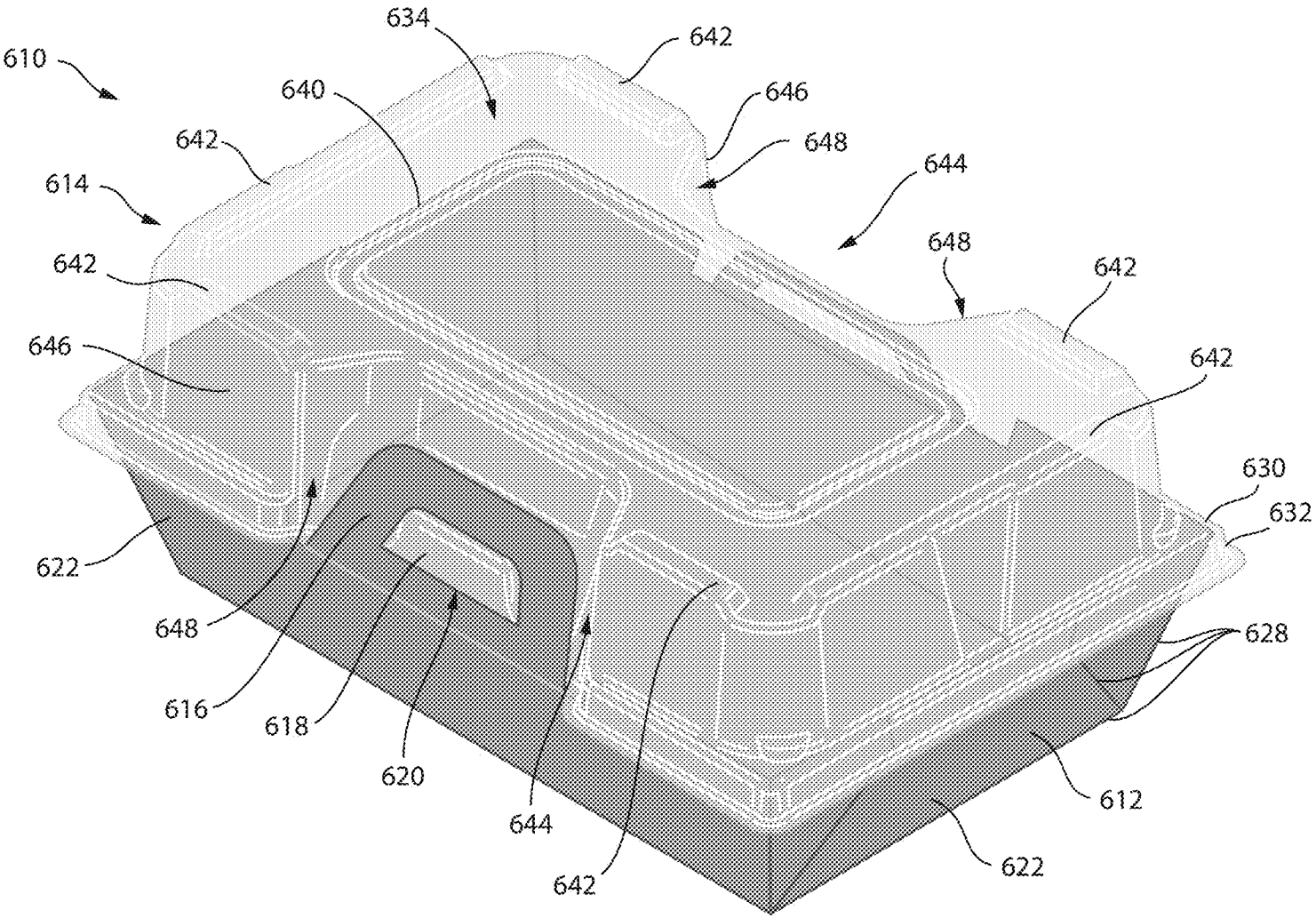
FIG. 6 is a perspective view showing one example of an improved hybrid container formed of a base and a lid that removably attach together, in embodiments.
Figure 7:
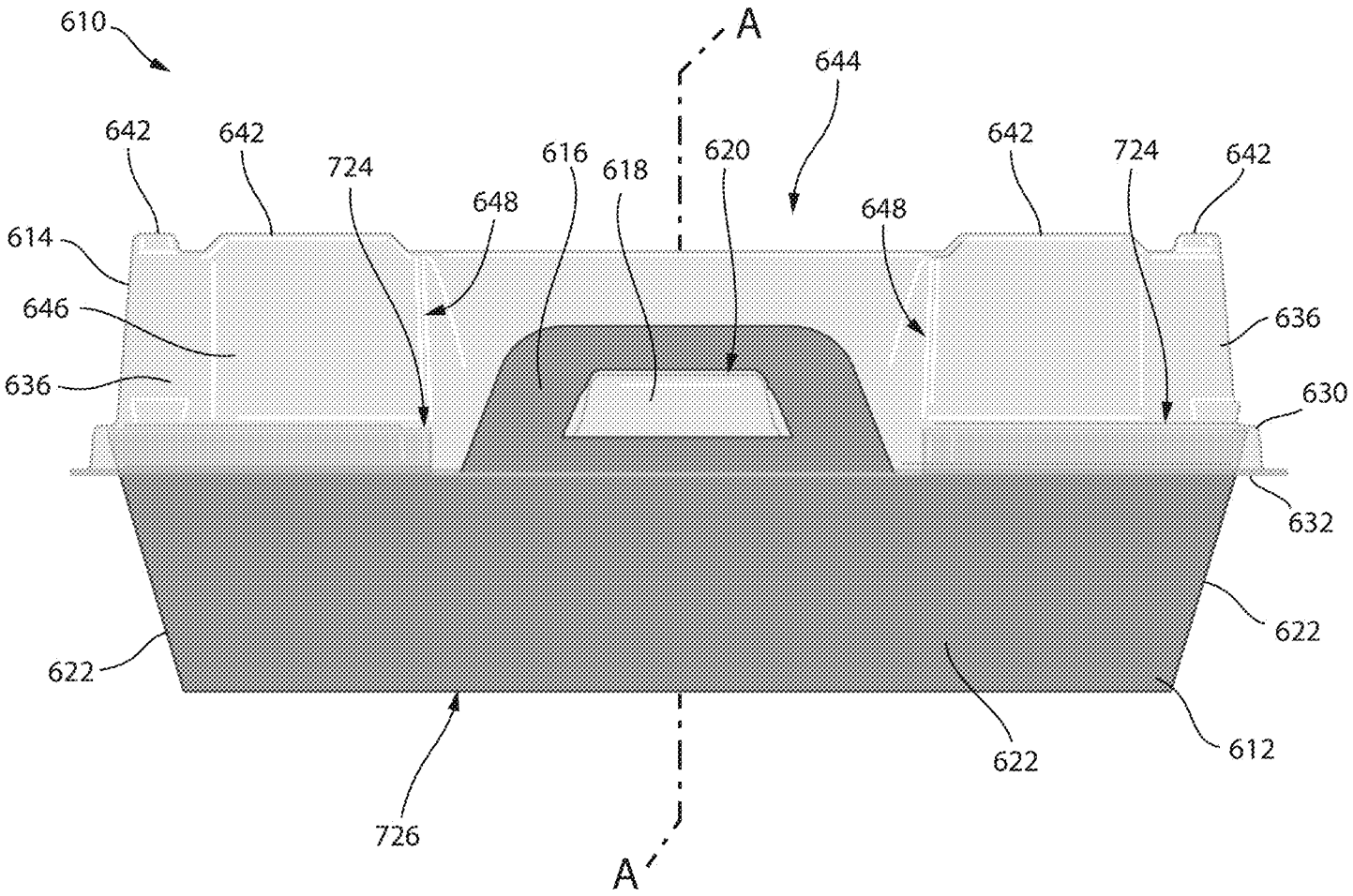
FIG. 7 is a front view of the improved hybrid container of FIG. 6, in embodiments.
Figure 8:
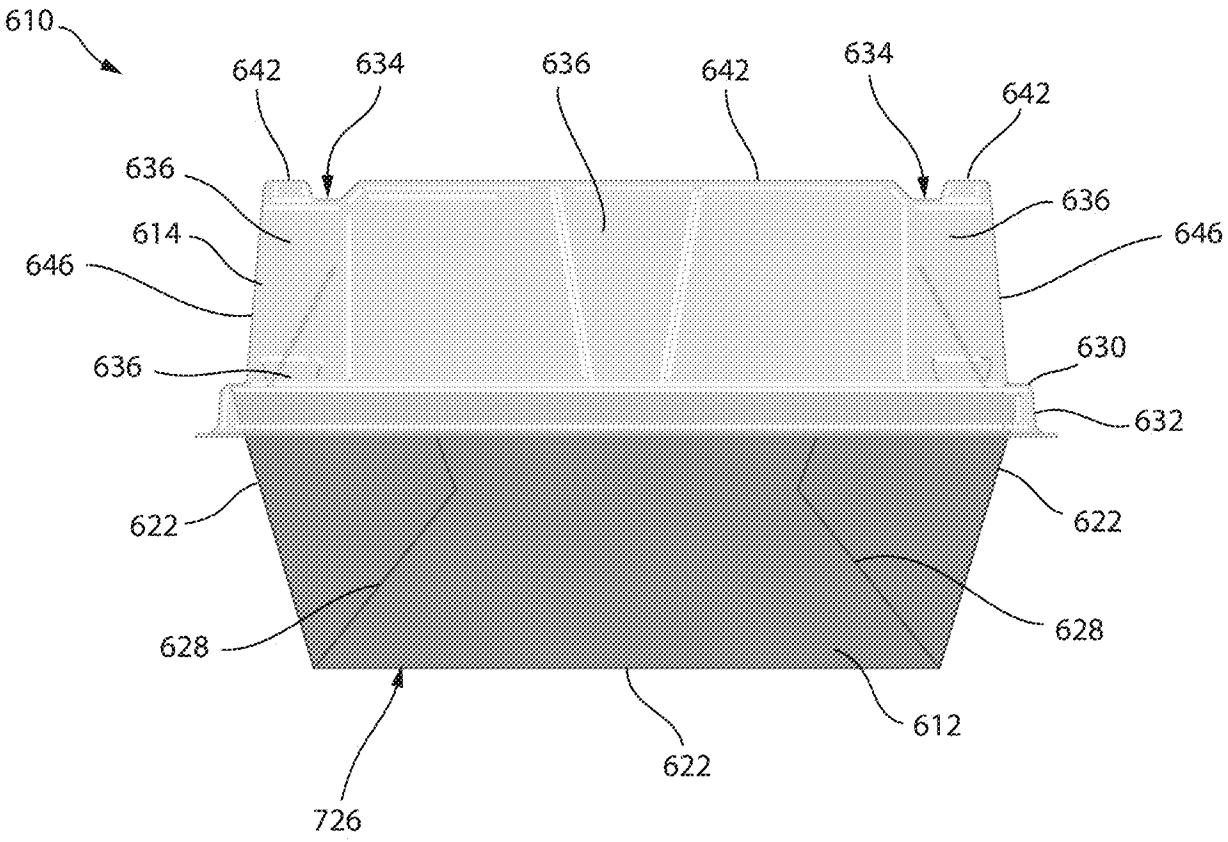
FIG. 8 is a side view of the improved hybrid container of FIG. 6, in embodiments.
Figure 9:
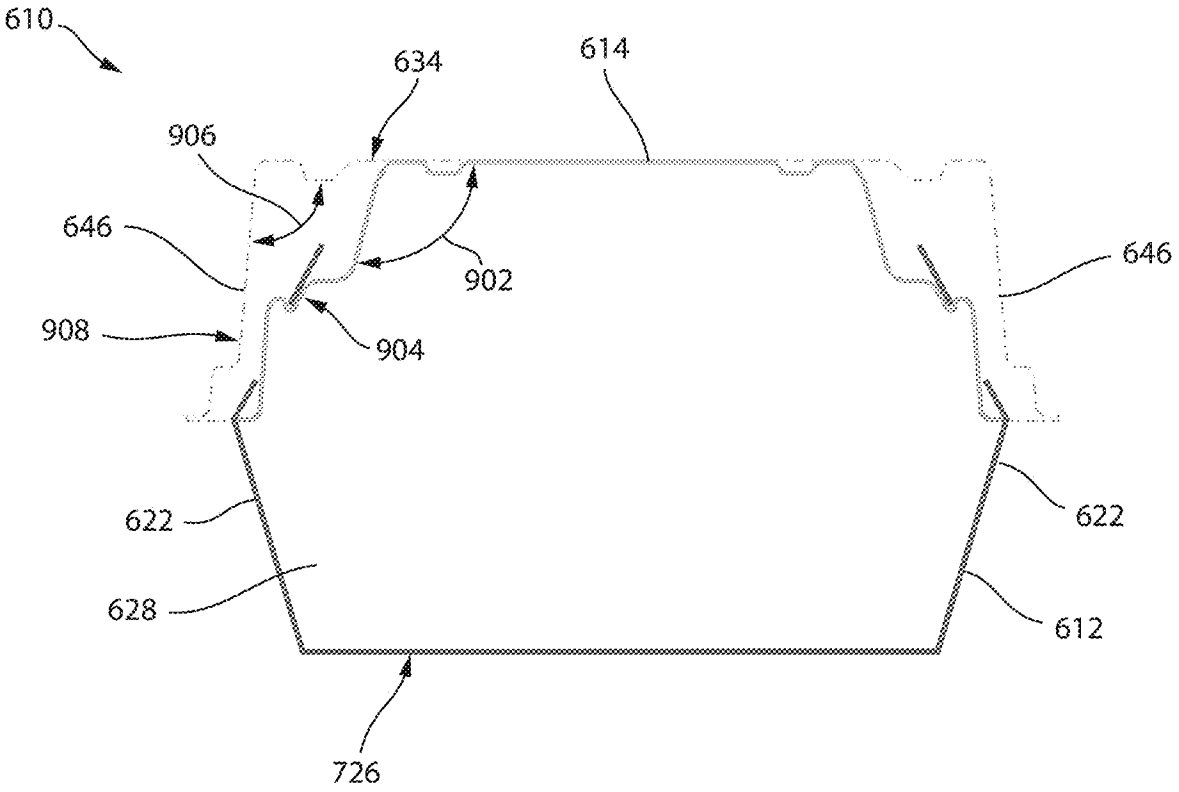
FIG. 9 is a cross section A-A through the hybrid container of FIG. 7, in embodiments.
Figure 10:
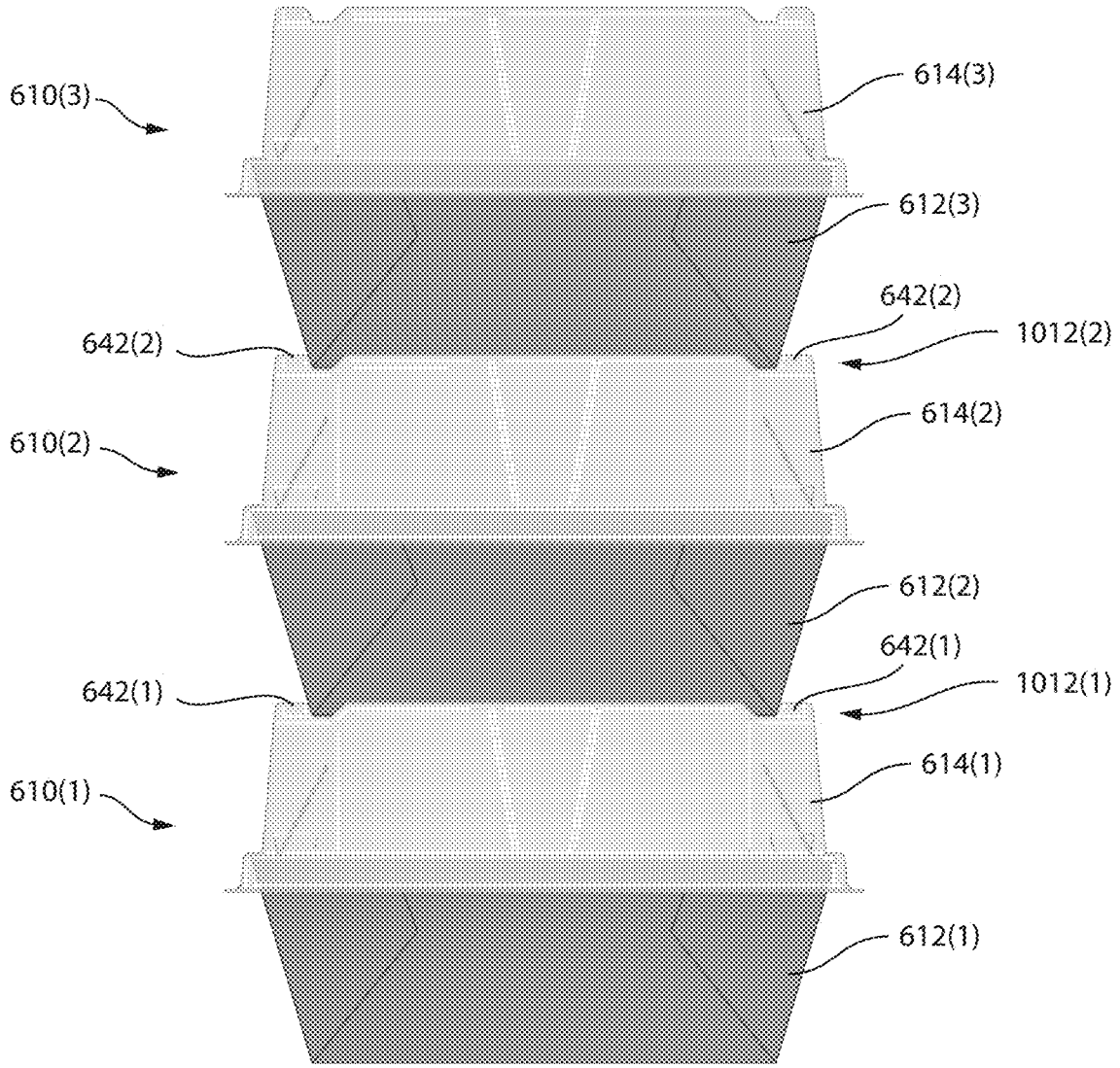
FIG. 10 is a side view showing a stack of the improved hybrid containers of FIGS. 6-9, in embodiments.

FIG. 6 is a perspective view showing one example of an improved hybrid container 600 formed of a base 612 and a lid 614 that removably attach together. FIG. 7 is a front view of the improved hybrid container 610 of FIG. 6. FIG. 8 is a side view of the improved hybrid container 610 of FIG. 6. FIG. 9 is a cross section A-A through the hybrid container 610 of FIG. 7. FIG. 10 is a side view showing a stack of the improved hybrid containers 610(1), 610(2), and 610(3) of FIG. 6. FIGS. 6-10 are best viewed together with the following description.

The base 612 is integrally formed from a paper material, and the lid 614 is integrally formed of plastic. The lid is molded in any desired shape and includes a lip 630 that engages an upper peripheral rim 724 (e.g., an upper edge) of base 612. The base further includes a bottom 626, sidewalls 622, and upper peripheral rim 724 which engages lid 614. The sidewalls 622 and the bottom 626 define a volume in which food is stored. The sidewalls 622 are tapered to provide structural integrity to the base 612 and aid in nesting within each other when in a stack prior to use for example.

In certain embodiments, the base 612 is made of a flat sheet of paper stock, such as pressed pulp, which is then folded along a plurality of fold lines 628 to form an intended shape. The paper stock is of sufficient rigidity to function as a food container and may also be coated or laminated on a surface, namely the surface that forms the inside of the base 612, with a hydrophobic material to limit water or oil absorption. As shown, the base 612 further includes a pair of loop-shaped flaps 616 (also called handles), each having a central opening 620.

The lid 614 includes an overhang 632 from lip 630 that is dimensioned to receive the upper peripheral rim 724 of the base 612 when the lip 630 engages the upper peripheral rim 724, such as when the lid 614 is mounted on the base 612 in an intended manner. The lid 614 forms an upper surface 634 and may include various strengthening features 636, such as ribs, push outs, and so on, to add strength and rigidity to the lid 614. The lid 614 also includes a plurality of upstanding rails 642, extending from the upper surface 634 in a direction away from the base 612, and formed around at least part of the periphery of the upper surface 634. The plurality of upstanding rails 642 are dimensioned to receive the base 612 of a stacked hybrid container (e.g., hybrid container 610(2)) positioned on the upper surface 634 of hybrid container 610(1) as shown in FIG. 10. The bottom 726 of the stacked hybrid container 610(2) contacts the upper surface 634 of the supporting hybrid container 610(1) without impediment (e.g., bottom 726 sits flush with the upper surface 634) and the plurality of upstanding rails 642 help prevent the stacked hybrid container 610(2) from sliding off of the hybrid container 610(1), such as when a stack of containers is carried or transported. The upstanding rails 642 further add strength and rigidity to the lid 614.

The lid 614 also forms at least two receiving regions 644 on opposing sidewalls 646 that are arranged to receive the loop-shaped flaps 616 of opposing sidewalls 622. The receiving regions 644 each include a seat 618 dimensioned to engage and releasably retain a corresponding one of the flaps 616 through its central opening 620. In particular, each receiving region 644 is recessed, towards a center of the lid 614, into an opposing sidewall 646 of the lid 614 and is bounded by receiving region walls 648 that are substantially orthogonal to a plane 908 of its opposing sidewall 646. The seat 618 extends back outward from the receiving region 644 towards the plane 908 of its sidewall 646, but does not extend beyond the plane 908 of its sidewall 646. The seat 618 releasably captures the flap 616 via the central opening 620 and thereby releasably couples the base 612 and the lid 614 together. Relative to the upper surface 634, a rear plane 904 of the receiving region 644 is at a shallower angle 902 than an angle 906 of the plane 908 of its sidewall 646. Particularly, angle 902, and thus the depth of the receiving region 644 relative to the plane 908 of its sidewall 646, is sufficient such that flap 616, when captured by the seat 618, does not extend above the upper surface 634 (or a plane thereof) and does not extend outside the plane 908 of its sidewall 646. Advantageously, it is not easy to inadvertently dislodged the flap 616 from the seat 618 during handling of the hybrid container 610. Further, region walls 648 add strength and rigidity to lid 614.

Hybrid container 610 includes many improvements over prior art hybrid container 10 of FIGS. 1-5. For example, as compared to the prior art regions 44, the receiving regions 644 for the flaps 616 are deeper and more sharply angled. Also, unlike the prior art flaps 16, the flaps 616 do not extend above the upper surface 634 of the lid 614 when engaged with seats 618.

Figure 1:
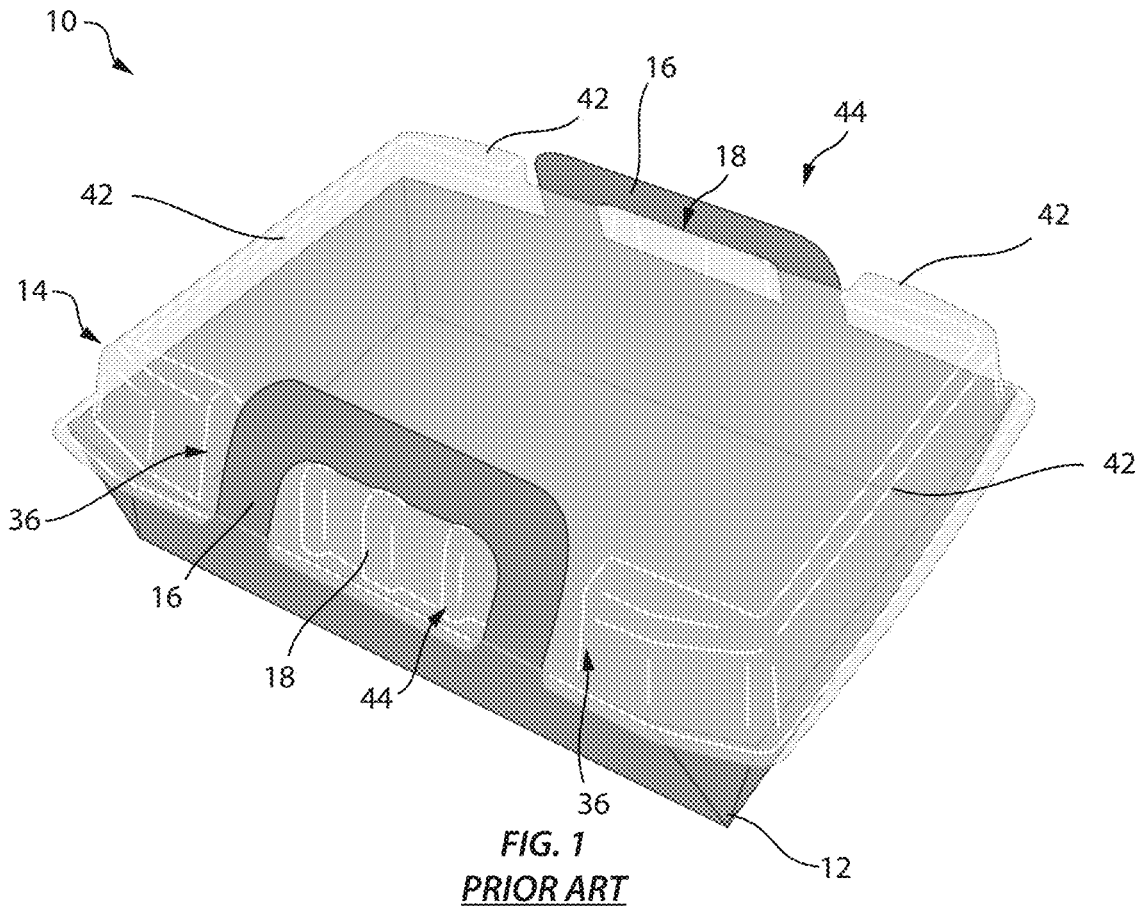
FIG. 1 PRIOR ART
FIGS. 1-4 show a prior art hybrid container.
Figure 2:
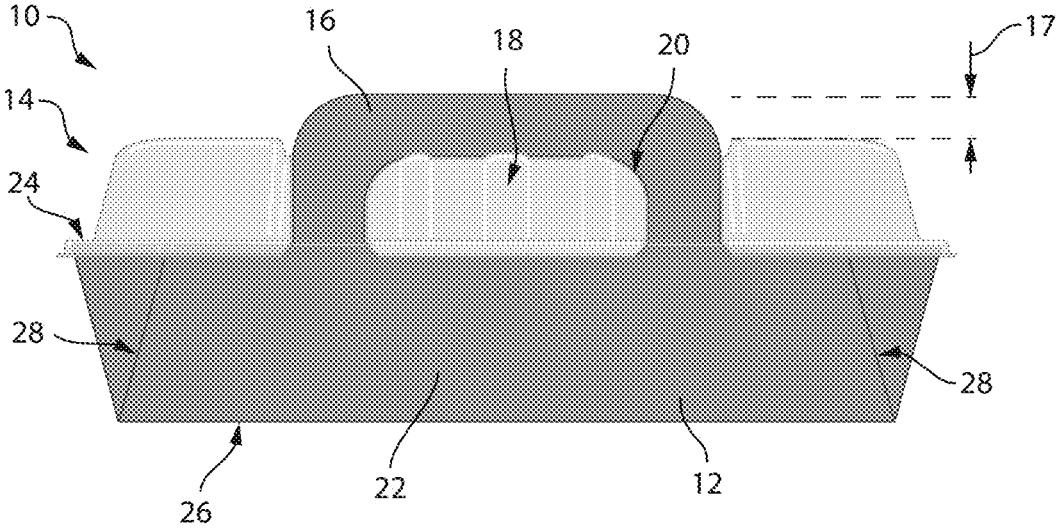
FIG. 2 PRIOR ART
Figure 3:
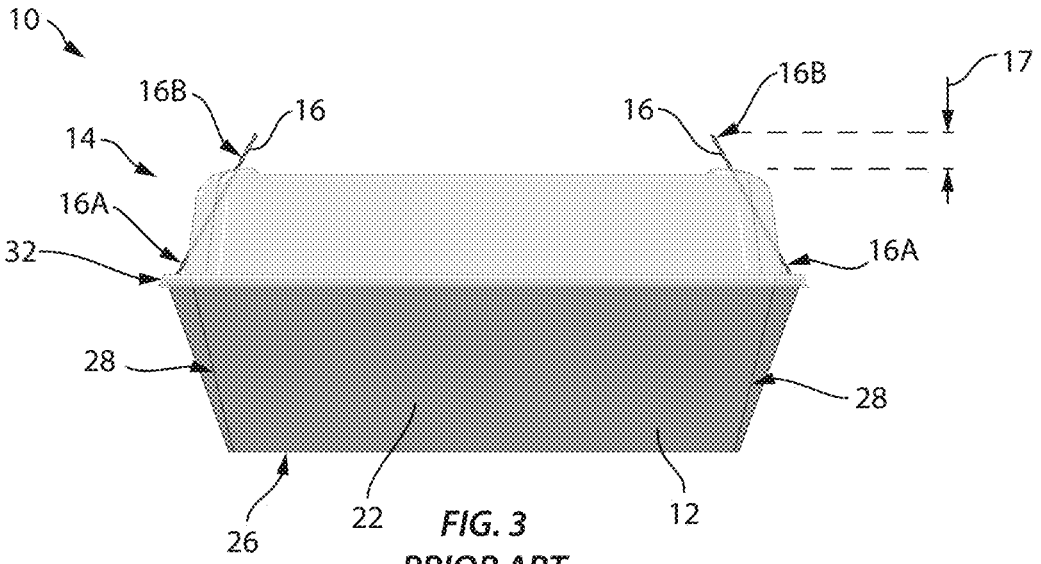
FIG. 3 PRIOR ART
Figure 4:
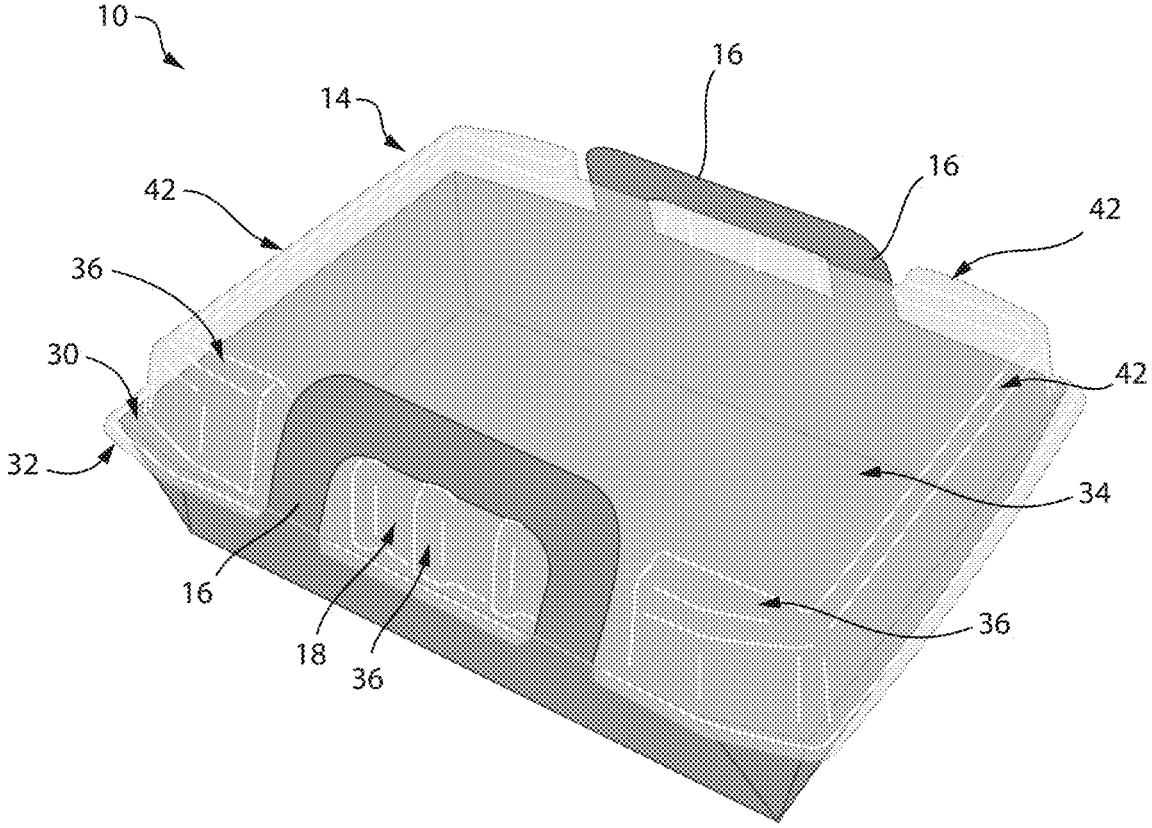
FIG. 4 PRIOR ART
Figure 5:
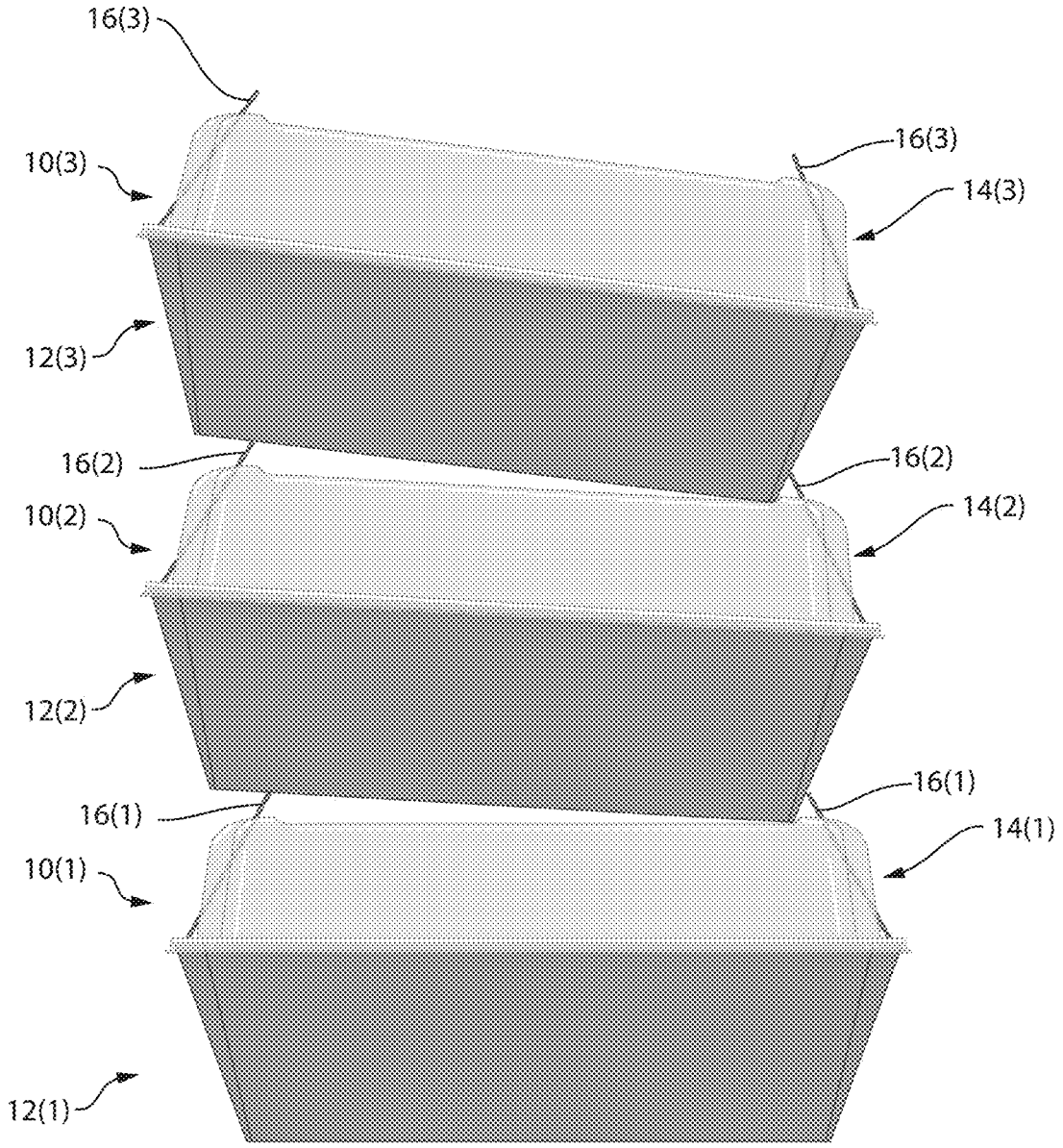
FIG. 5 PRIOR ART
FIG. 5 is a side view showing a stack of the prior art hybrid containers of FIGS. 1-4.

A comparison of the side view of the hybrid container 610 of FIG. 8 to the prior art hybrid container 10 shown in FIG. 3 shows further benefits of the hybrid container 610 over the prior art hybrid container 10. In particular, the flaps 616 have no exposed regions when each flap 616 is engaged with its respective seat 618, unlike exposed regions 16A and 16B of prior art flaps 16. In other words, receiving region walls 648 of the receiving regions 644 in which the seats 618 are located, are sufficiently angled inward toward the upper surface 634 such that the entire flaps 616 are shielded from inadvertent contact when handling or stacking the hybrid container 610. See, for example, the side view of the hybrid container 610 shown in FIG. 8 where the flaps 616 are not visible.

Although the embodiment of FIGS. 6-10 show the flaps 616 terminating well below the upper surface 634, the flaps 616 may, instead, terminate at, but not above, the upper surface 634 without departing from the scope hereof.

The lid 614 may also include a strengthening ring 640, formed at upper surface 634 and centrally located, to provide additional support for a stacked hybrid container. In this embodiment, strengthening ring 640 is a trough formed in the surface 634. Advantageously, the upper surface 634 of the lid 614 between the rails 642 is substantially planar to allow stacking of hybrid containers 610. In addition, the flaps 616 are fully contained within the receiving regions 644 when retained by the seat 618 and do not extend upward above upper surface 634 (as opposed to flaps 16 of prior art hybrid container 10 shown in FIG. 3), each container 610 may be positioned in a fully horizontal state (e.g., the bottom 626 of base 612 of a stacked hybrid container 610 is coplanar with upper surface 634 of the lid 614 of a stacked hybrid container 610) when stacked vertically as shown in FIG. 10. This allows for more efficient use of counter or refrigerated display space and also reduces susceptibility to tipping while the stacked hybrid containers 610 are in transit (e.g., for take-out delivery).

The improved hybrid container 610 may be described as having: an integrally formed base made from paper and having a bottom and opposing side walls with an upper peripheral rim, and defining a volume, and at least two flaps, one on each opposing sidewall, with each flap pivotable with respect to its sidewall, wherein each flap is configured as a loop having a central opening;

An integrally formed lid of transparent or translucent plastic material and dimensioned for positioning on the rim of the base, the lid having an upper surface, side walls and receiving regions on at least two opposing side walls, the receiving regions bounded by receiving region walls and angled with respect to the upper surface of the lid and having a seat dimensioned for releasable engagement with the loop of each flap of the base, wherein the receiving regions completely receive each flap when the flaps are connected to the seats.

Thus, while there have shown and described and pointed out fundamental novel features of certain embodiments, it will be understood that various omissions and substitutions and changes in the form and details of the devices illustrated, and in their operation, may be made by those skilled in the art without departing from the scope hereof. For example, it is expressly intended that all combinations of those elements and/or method steps which perform substantially the same function in substantially the same way to achieve the same results are within the scope hereof. Moreover, it should be recognized that structures and/or elements and/or method steps shown and/or described in connection with any disclosed form or embodiment may be incorporated in any other disclosed or described or suggested form or embodiment as a general matter of design choice. It is the intention, therefore, to be limited only as indicated by the scope of the claims appended hereto.

What is claimed is:

1. A hybrid container, comprising:

an integrally formed base made from a paper material and having a bottom, opposing first sidewalls forming an upper peripheral rim, and at least two flaps each configured as a loop with a central opening and extending from a different one of the opposing first sidewalls and pivotable with respect to its first sidewall; and an integrally formed plastic lid dimensioned for positioning on the upper peripheral rim of the base and having an upper surface, opposing second sidewalls having a planar surface forming a first angle with the upper surface, and at least two receiving regions each formed on a different one of the opposing second sidewalls and having a rear planar surface formed, with respect to the upper surface of the lid, at a second angle larger than the first angle, each receiving region forming a seat dimensioned to engage with the central opening of one of the flaps to removably retain the flap completely within the receiving region, wherein the flaps are fully contained within the receiving regions when the flaps are retained by the seats.

2. The hybrid container of claim 1, each of the flaps not extending outside of the planar surface of its second sidewall when retained by its seat.

3. The hybrid container of claim 2, each of the flaps not extending above the upper surface when retained by its seat.

4. The hybrid container of claim 1, the plastic material being one of transparent and translucent.

5. The hybrid container of claim 1, each seat extending outward from its corresponding rear plane and not extending beyond the plane of the its second sidewall.

6. The hybrid container of claim 1, the lid further comprising a strengthening ring formed at the upper surface.

7. The hybrid container of claim 6, the strengthening ring comprising a trough formed at the upper surface without extending above the upper surface.

8. The hybrid container of claim 1, the lid further comprising a lip to engage the upper peripheral rim of the base and an overhang extending from the lip and dimensioned to receive the upper peripheral rim when the lip engages the upper peripheral rim.

9. The hybrid container of claim 1, the lid further comprising a plurality of upstanding rails extending from the upper surface in a direction away from the base.

10. The hybrid container of claim 9, the plurality of upstanding rails being formed around at least part of a periphery of the upper surface to receive a base of a stacked second hybrid container.

11. The hybrid container of claim 1, the bottom and opposing first sidewalls of the base defining a volume.

12. The hybrid container of claim 1, each of the receiving regions being bounded by receiving region walls formed orthogonal to the plane of its second sidewall.

* * * * *